US009821484B2

(12) United States Patent
Este et al.

(10) Patent No.: US 9,821,484 B2
(45) Date of Patent: Nov. 21, 2017

(54) METHOD AND DEVICE FOR SEPARATING PRODUCTS GROUPED IN BLISTER PACKS

(71) Applicant: SWISSLOG ITALIA S.P.A., Milan (IT)

(72) Inventors: Flavio Este, Selvazzano Dentro (IT); Lorenzo Spagna, Guastalla (IT); Luca Natali, Lugo (IT)

(73) Assignee: SWISSLOG ITALIA S.P.A., Milan (IT)

( * ) Notice: Subject to any disclaimer, the term of this patent is extended or adjusted under 35 U.S.C. 154(b) by 25 days.

(21) Appl. No.: 14/903,116

(22) PCT Filed: Jul. 21, 2014

(86) PCT No.: PCT/IB2014/063281

§ 371 (c)(1),
(2) Date: Jan. 6, 2016

(87) PCT Pub. No.: WO2015/011631

PCT Pub. Date: Jan. 29, 2015

(65) Prior Publication Data

US 2016/0158952 A1 Jun. 9, 2016

(30) Foreign Application Priority Data

Jul. 26, 2013 (IT) ..... BO2013A0407

(51) Int. Cl.
*B26D 5/00* (2006.01)
*B65B 61/06* (2006.01)
(Continued)

(52) U.S. Cl.
CPC ..... *B26D 5/007* (2013.01); *A61J 1/035* (2013.01); *B26D 5/28* (2013.01); *B65B 57/02* (2013.01); *B65B 61/06* (2013.01)

(58) Field of Classification Search
CPC . B26D 5/007; B26D 5/28; A61J 1/035; B26B 57/02; B26B 61/06
(Continued)

(56) References Cited

U.S. PATENT DOCUMENTS 4,909,414 A 3/1990 Heath
5,586,479 A * 12/1996 Roy ..... B26D 7/015 346/24
(Continued)

FOREIGN PATENT DOCUMENTS

EP 1 560 756 A1 8/2005
EP 2 301 850 A2 3/2011
(Continued)

OTHER PUBLICATIONS

English translation of Notification of Transmittal of International Search Report issued in Application No. PCT/IB2014/063281, dated Sep. 30, 2014 (1 page).
(Continued)

*Primary Examiner* — Ghassem Alie
(74) *Attorney, Agent, or Firm* — Flynn, Thiel, Boutell & Tanis, P.C.

(57) ABSTRACT

Device for separating products grouped in blister packs with a plurality of pockets. The device includes a system for identifying the positions of the pockets relative to the edge of the blister pack. The system for identifying the positions of the pockets relative to the edge of the blister pack includes a three-dimensional profiling device and/or a photometric stereo viewing system.

9 Claims, 3 Drawing Sheets

(51) Int. Cl.
*B65B 57/02* (2006.01)
*A61J 1/03* (2006.01)
*B26D 5/28* (2006.01)

(58) Field of Classification Search
USPC ..... 83/13, 56, 73, 75.5, 76.8, 74, 368, 371, 83/404.1, 419; 700/240, 244; 221/30; 206/538, 531, 534.1
See application file for complete search history.

(56) References Cited

U.S. PATENT DOCUMENTS 5,799,468 A * 9/1998 Eck ..... B65B 57/10 53/237
6,202,524 B1 * 3/2001 Cunningham ..... C03B 33/03 451/11
6,889,588 B1 5/2005 Jenkins
2005/0046872 A1 * 3/2005 Hu ..... G06T 7/521 356/603
2008/0063261 A1 * 3/2008 Kang ..... G01N 21/8851 382/154
2008/0295659 A1 * 12/2008 Tobin ..... B26D 5/34 83/13
2010/0249997 A1 * 9/2010 Greyshock ..... G07F 11/54 700/240
2011/0102550 A1 * 5/2011 Daniel ..... G06T 7/55 348/46
2013/0218330 A1 * 8/2013 Chudy ..... G06F 19/3462 700/244

FOREIGN PATENT DOCUMENTS

WO WO 2004/033306 A1 4/2004
WO WO 2010/095102 A1 8/2010
WO WO 2012/020354 A1 2/2012

OTHER PUBLICATIONS

English translation of International Search Report issued in Application No. PCT/IB2014/063281, dated Sep. 30, 2014 (6 pages).
English translation of Written Opinion of the International Searching Authority issued in Application No. PCT/IB2014/063281, dated Sep. 30, 2014 (6 pages).

* cited by examiner

METHOD AND DEVICE FOR SEPARATING PRODUCTS GROUPED IN BLISTER PACKS

FIELD OF THE INVENTION

The present invention relates to a method and a device for separating products grouped in blister packs.

The invention was devised particularly, although not exclusively, with regard to a device for separating products, such as unit doses of medicines packaged in blister packs, by separating portions of the blister pack, where each portion contains a single product.

BACKGROUND OF THE INVENTION

Medicines in the form of pills, capsules, tablets and the like are generally packaged in blister packs. A blister pack usually comprises a generally quadrangular tray with a set of pockets or bubble housings into which the pills or the like are inserted. The bubble housings, or pockets, are sealed with a sealing film, typically made of aluminium or paper, stretched over the tray and bonded thereto. Alternatively, the pills can be enclosed in compartments created between two flexible films bonded together.

As is known, blister packs provide a convenient packaging solution for those who use medicines occasionally, but are much less suitable for use in a hospital environment, where it is preferable for medicines to be stored separately in single doses, to allow more precise and regular distribution in the various wards according to the dosage regime for each patient.

The advent of automatic medicine management systems in the hospital environment has made it necessary to provide a mechanism for automatically separating the single doses grouped in blister packs from one another.

There are known separator devices suitable for this purpose, for example the device described in European Patent EP 1 560 756 held by the present applicant, in which two pairs of blades cut the blister pack along predetermined straight lines so as to separate the pockets of the blister pack, each containing a unit dose of medicine, from one another, while keeping each medicine sealed in its pocket. Although the device disclosed in this European Patent has proved effective in numerous applications, it is not suitable for use with certain types of blister packs; this is because, in 40-60% of cases, the pockets are arranged in a complex layout which prevents separation by means of this device.

In order to overcome this drawback, the applicant has developed a further separator device, disclosed in International Patent Application WO 2012/020354. This separator device uses an ultrasonic cutting head to cut the blister packs along paths predetermined according to cutting schemes, including complex schemes, associated with each different type of blister pack. In the use of this separator device, a blister pack is positioned on a bearing surface, from which, for example, the ultrasonic cutting head projects, in a predetermined reference position which is defined, for example, by a stop such as a projecting edge of the bearing surface, which is located at one of the corners of the surface and is therefore L-shaped. From this predetermined reference position, the blister pack is then moved on the bearing surface in a series of predetermined movements which define the cutting of the blister pack by the ultrasonic cutting head.

The separator device disclosed by WO 2012/020354 can be used for the effective separation of a certain number of types of blister pack, having layouts which may be rather complex. However, there are some types of blister packs in which the pockets containing the products to be separated are very close to one another, and for these packs the cutting must be carried out with very high precision to avoid nicking a pocket and thus compromising the sterility of the medicine contained in it. Even where it is possible to achieve such high precision with the prior art separator devices, particularly close manufacturing tolerances and constant monitoring of the mechanical play are required, resulting in a high cost for the manufacture of the separator device and for its continuous use and periodic maintenance.

In greater detail, the applicant has discovered that, in blister packs of a single medicament produced by a given pharmaceutical firm, the distance of the pockets from the edge of the blister pack is subject to a degree of variability, although the pockets are always in the same specific relative arrangement and at the same distance from one another. In the case of blister packs with very closely spaced pockets, in which the distance from one pocket to another may be less than 2 mm, this lack of precision in the distance between the blister pack edge and the pockets, although small in absolute terms, may be sufficient to compromise the integrity of one or more pockets during the cutting of the blister pack, especially given that the blade typically has a thickness of about 0.65 mm, which is significant relative to the distance between two adjacent pockets.

SUMMARY OF THE INVENTION

The present invention therefore proposes to provide a separator device for the precise and reliable separation of products grouped in a blister pack or in a multiple package of the same kind. Another object of the invention is to provide a device that is adapted to separate any type of blister pack. Another object of the present invention is to provide a device for separating products that is simple, economical and safe in use. Another object of the invention is to provide a separator device that requires no frequent or complex maintenance operations. Another object of the invention is to provide a separator device such that there is no damage to the medicines and no production of debris or fumes or any potentially harmful or polluting waste products.

In order to achieve the aforementioned objects, the applicant has developed a device for separating products grouped in blister packs having a plurality of pockets, the device comprising a system for identifying the positions of the pockets relative to the edge of the blister pack.

Further characteristics and advantages will become evident from the following detailed description of two embodiments of the invention, with reference to the attached drawings, provided purely by way of non-limiting example.

DETAILED DESCRIPTION

Figure 1:
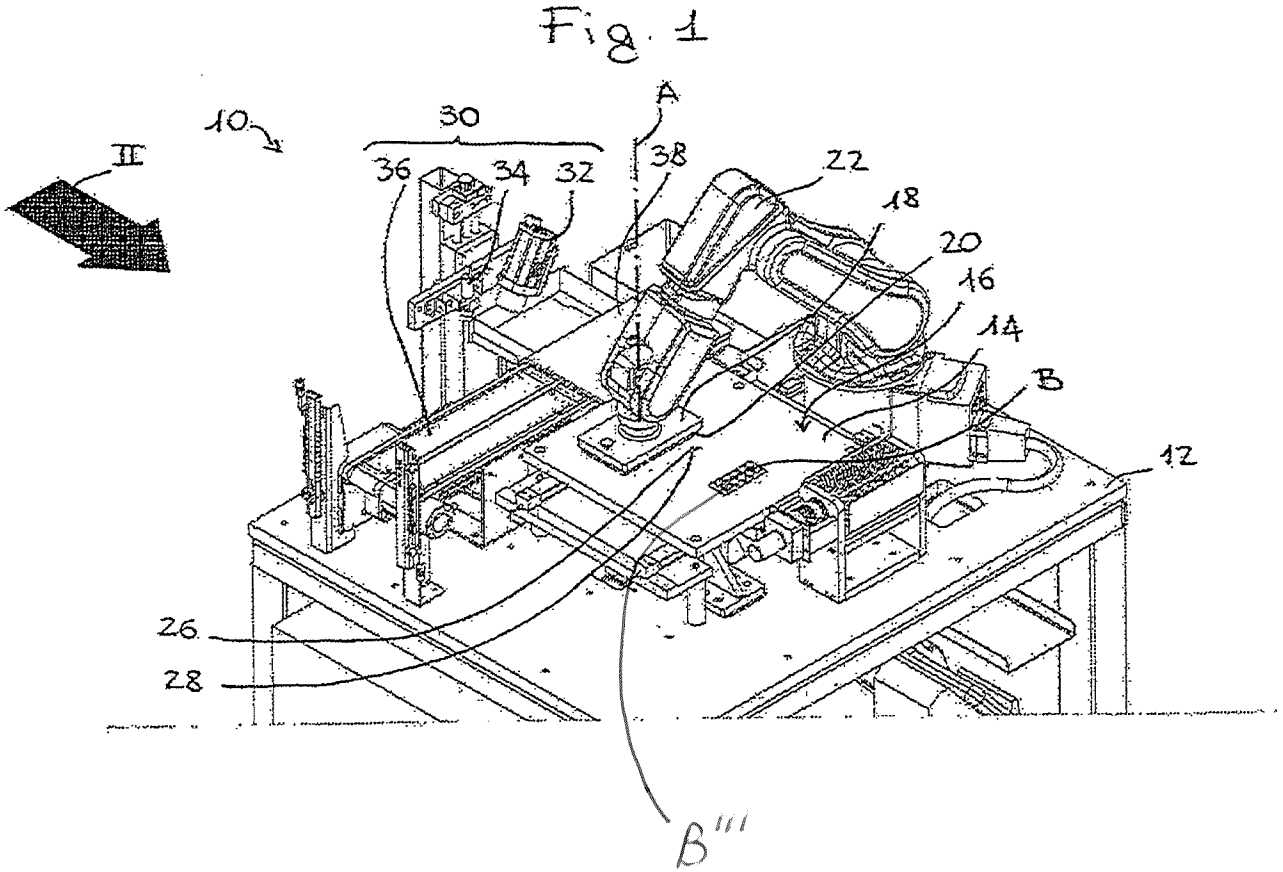
FIG. 1 shows an overall perspective view of a separator device according to a first embodiment of the invention.
Figure 2:
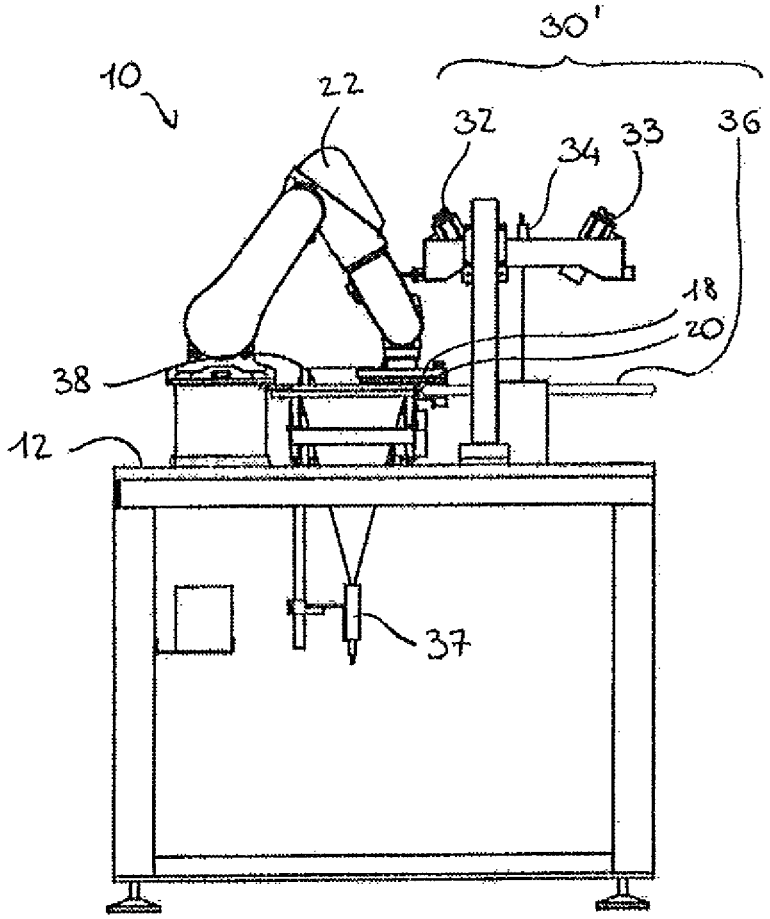
FIG. 2 shows a schematic view of a variant of the device of FIG. 1, taken in the direction of the arrow II of FIG. 1.

With reference now to FIGS. 1 and 2, a separator or separator device or separation device 10 comprises a base structure 12 on which is mounted and fixed a support platform 14 with a bearing surface 16 extending on a reference plane having the coordinates X-Y. Above the support platform there is provided a pressure member 18 for a blister pack B, the flat surface of which bears on the bearing surface 16. A pad 20 of a material with a high coefficient of friction, for example rubber, is preferably provided between this pressure member and the blister pack. The pressure member is mounted on an anthropomorphic robot or other movement device 22 of a known type, which has a general capacity for movement in a plane parallel to the reference plane X-Y, as well as a capacity for moving towards and away from the bearing surface 16, and is rotatable about an axis A of the pressure member.

A cutting head comprising an ultrasonic oscillator, of a generally known type, is provided under the support platform 14 (and is therefore not visible in the drawing). The device is mounted on an axis Z (which is not shown and which is preferably perpendicular to the plane X-Y) for adjusting the projection of the blade as required. A blade 26 is fixed to the upper end of the cutting head and projects above the bearing surface 16 of the support platform 14 through a slot 28 formed in the platform.

The device also has a system for identifying the positions of the pockets relative to the edge of the blister pack. In the first embodiment shown in FIG. 1, and in its variant shown in FIG. 2, this system has a three-dimensional profiling device 30, 30', of the laser line scanner type for example. The laser line scanner is a system for acquiring the shape of an object by triangulation, based on the observation of the deformation of a laser light beam projected on to the surface under investigation. The three-dimensional profiling device 30, 30' comprises a video camera 32, a laser beam projector 34 and a conveyor belt 36 which moves the blister packs while transporting them from the entry of the separator to the support platform 14.

The separation device further comprises a camera 37 placed beneath a transparent portion 38 of the support platform 14, positioned with its lens aimed towards the transparent portion 38 of the support platform, to photograph a blister pack located above it. Preferably, the camera is aimed perpendicularly to the transparent portion 38 of the support platform 14.

All the components of the separation device are controlled by a control unit which is not shown, for example an electronic computer, which, for example, determines the movement in space of the movement device 22, parallel to the plane X-Y, about the axis A of the pressure member, and along an axis Z in the direction away from the reference plane X-Y, the axis Z being preferably, but not necessarily, orthogonal to the reference plane. The control unit may advantageously also control the activation of the ultrasonic oscillator, to synchronize it with the movement of the pressure member 18. The control unit has an internal or external memory in which it is possible to store the instructions for cutting schemes, including complex schemes, associated with each different type of blister pack. Complex cuts include movements in the plane X-Y, rotations and elevations of the pressure member, according to a predetermined sequence.

In use, a blister pack B with a terminal outer edge B', and a base B", the base B" including a plurality of raised areas B"' each defining a pocket V with a boundary B"" (of the type shown in FIGS. 1 and 3), is placed on the conveyor belt 36 with its flat bottom side in contact with the conveyor belt. During the movement of the blister pack B, the laser beam projector 34 projects a light beam on to it. If no blister pack is present, the beam describes a straight line on the conveyor belt. However, if the blister pack is placed in the light beam, the line is deformed and describes the profile of the blister pack and its pockets. The video camera 32 acquires, in sequence, the images of the line deformed in this way; when the mutually assumed position and inclination of the laser light source relative to the video camera 32 at each instant is known, a three-dimensional reconstruction of the blister pack is obtained from these images, showing the exact location of the pockets V relative to the edge B' of the blister pack B.

In a variant shown in FIG. 2, a second video camera 33, placed approximately symmetrically to the video camera 32 relative to the laser light beam projector 34, is provided in order to increase further the precision of the three-dimensional reconstruction. This second video camera is opposed to the first, and therefore detects the laser beam in areas invisible to the first video camera, particularly on the shaded side of each pocket.

Figure 3:
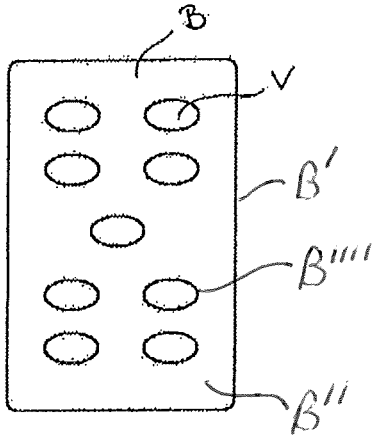
FIG. 3 shows a schematic view of a blister pack that can be separated by the separator device of FIG. 1.
Figure 4:
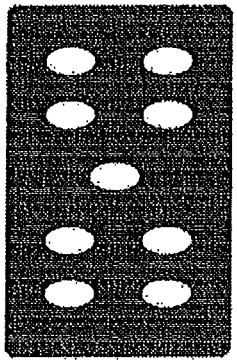
FIG. 4 shows a two-dimensional diagram representing only the contour of the profile of the blister pack of FIG. 3 and the positions and sizes of its pockets.
Figure 5:
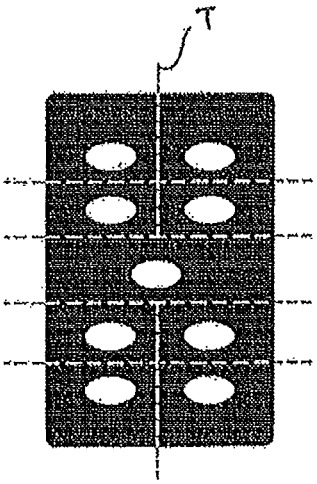
FIG. 5 shows the cutting lines for the blister pack of FIG. 3 associated with the two-dimensional diagram of FIG. 4.

The three-dimensional image obtained with one or two video cameras is then processed so as to provide a two-dimensional diagram representing only the contour of the profile of the blister pack and the positions and sizes of the pockets. An example of a two-dimensional diagram of this type relating to the blister pack of FIG. 3 is shown in FIG. 4. A cutting scheme is retrieved from a memory on the basis of the mutual positioning of the pockets, without regard to the position of the edge of the blister pack, this scheme comprising cutting lines T and the sequence of movements to be performed in order to make these cuts and separate the doses in the blister pack. The cutting lines are associated with the two-dimensional scheme (an example is shown in FIG. 5) and are also subsequently associated with the position of the edge B' of the blister pack B.

The blister pack is then transferred to the transparent portion 38 of the support platform 14, where the pressure member 18 brings the pad 20 into contact with the blister pack, and where the camera 37, placed beneath the transparent portion 38, photographs the flat lower side of the blister pack. The image obtained in this way is used to verify the exact position of the edge B' of the blister pack B relative to the pad 20. The image is also correlated with the two-dimensional diagram of the blister pack and the corresponding cutting lines T. Thus the cutting lines, calculated in advance on the basis of the positions of the pockets and subsequently associated with the edge B' of the blister pack, are associated with the position of the pad 20.

The blister pack is then shifted by the pad 20 on to the bearing surface 16 of the support platform 14, and is kept pressed on to this surface by the pressure member 18. The control unit then causes the activation of the cutting head 24; the blade 26, which projects above the bearing surface 16 of the support platform 14 through the slot 28, begins to oscillate.

On the basis of the cutting scheme associated with the blister pack, the control unit controls the movement device 22 and the pressure member 18, thereby determining the movement of the pad 20, together with the blister pack, which slides on the bearing surface 16 until it contacts the blade 26. The relative movement between the blister pack and the blade 26, which oscillates, determines the cut made through the thickness of the blister pack.

According to a second embodiment of the present invention, the system for identifying the positions of the pockets relative to the edge of the blister pack comprises a viewing system known as "photometric stereo". This is a three-dimensional viewing system which enables the orientation of a surface under examination to be reconstructed on the basis of a plurality of images obtained with different illumination. The other components of the separator device are equivalent to those described above with reference to the first embodiment, and are indicated by the same reference numerals.

Figure 6:
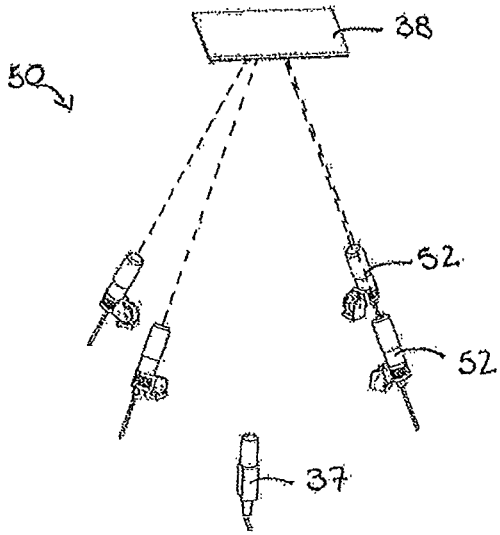
FIG. 6 shows schematically the system for identifying the positions of the pockets relative to the edge of the blister pack in a separator device according to a second embodiment of the invention.

With reference to FIG. 6, the photometric stereo viewing system 50 comprises a plurality of projectors 52, preferably four, placed beneath the transparent portion 38 of the support platform 14. The projectors 52 are orientated so as to illuminate at a predetermined angle a lower side of an object resting on the transparent portion 38 of the support platform 14, each projector having a different orientation of the illuminating beam. The angle of incidence of the projected light on the object is in the range from 30° to 70°. The four directions of the four projectors 52 of the illustrated example are shown in broken lines in the figure. Evidently, there is no reason to exclude systems having only three or only two projectors, or systems having more than four projectors. The photometric stereo viewing system 50 further comprises the camera 37 described above in relation to the first embodiment, placed beneath the transparent portion 38.

In use, a blister pack B, with a plurality of pockets V, of the type shown in FIG. 2, is placed on the conveyor belt 36 with its flat side in contact with the conveyor belt. The blister pack is thus transferred to the transparent portion 38 of the support platform 14, where the pressure member 18 brings the pad 20 into contact with the blister pack, which is thus pressed against the transparent portion 38 of the support platform 14 to ensure that it is kept flat on the transparent portion 38; this is because blister packs sometimes tend to be slightly bowed. The projectors 52 are activated in sequence and the blister pack is photographed by the camera 37. Thus an image is recorded for each projector 52, each image showing the flat side of the blister pack illuminated by a single projector 52.

In most cases, a blister pack has an aluminium foil on its flat side. This foil is embossed, that is to say it has a marked surface irregularity, caused by the bonding of the aluminium foil to the plastic tray. At the positions of the pockets, however, the aluminium is not bonded and has a uniform and substantially smooth surface. When the flat side of the blister pack is illuminated with raking light, there is an alternation of shaded and illuminated areas in the embossed part, whereas the illumination is substantially uniform at the positions of the pockets. The resulting images can be processed to provide a two-dimensional diagram entirely similar to that of FIG. 2, obtained with the first embodiment described above. On the basis of this diagram, the operations of defining the cutting lines and cutting the blister pack then take place in an entirely similar manner to that described above.

However, some less common blister packs have a flat side made of cardboard, which is substantially flat and shows no significant discontinuities at the positions of the pockets. On the other hand, these blister packs are precut; that is to say, they have a non-continuous incision to facilitate the manual separation of the doses. The non-continuous incision, like any surface irregularity, is easily identified by the photometric stereo viewing system 50. Consequently, a grid, instead of a two-dimensional diagram like that of FIG. 2, is obtained for these blister packs. For each blister pack, the grid of incisions may be positioned in a different way relative to the edge of the blister pack, but, since the grid determines the lines along which the blister pack can be torn to separate the doses of medicine, it is always accurately positioned in the spaces between one pocket and the adjacent pockets. It can therefore be used directly for the accurate definition of the cutting lines, so that cutting can then take place in an entirely similar manner to that described above.

Yet another type of blister pack has two sides, both provided with pockets; consequently there is no flat side. In this case, evidently, the side of the blister pack in contact with the transparent portion 38 of the support platform is not flat, but has significant projections at the position of each pill, tablet or the like. The photometric stereo viewing system 50 is also suitable for this type of blister pack, because, as mentioned above, it detects variations of the inclination of the surface, and can therefore produce a three-dimensional reconstruction of the structure of the lower side of the blister pack, so as to provide a two-dimensional diagram similar to that of FIG. 5.

The photometric stereo viewing system 50 is therefore suitable for any type of blister pack currently available on the market, including those having the tray with pockets made of transparent plastic, which are difficult to identify with a viewing system based on laser profiling. This is because, if the pockets are transparent, the laser profiling detects only the positions of the capsules or pills inside them, but these may be much smaller than the pockets in which they are housed. Therefore the detection of the pills alone does not enable the edges of the pockets to be detected with the necessary precision. If the medicaments contained in the pockets are also transparent (gel capsules, for example), laser profiling would fail completely, whereas the photometric stereo viewing system 50 is unaffected.

On the other hand, with the photometric stereo viewing system 50, problems may arise in identifying the pockets in the case of blister packs having very large amounts of text on their bases, which prevents the detection of discontinuities.

To overcome the problems of the three-dimensional profiling device 30, 30', described as the first embodiment, and of the photometric stereo viewing system 50, the two viewing systems may be used in the same separation device, to ensure that fully automatic separation can always be carried out successfully.

Thus this combination analyses the blister pack from two opposed viewpoints, such that the observation of the base of the blister pack can be combined with the observation of the upper side. In this way, any type of blister pack, including those with transparent pockets, transparent medicaments, or dark text on the base, can be efficiently separated. Furthermore, this combination also makes it possible to distinguish between full and empty pockets, both present in the same blister pack in some cases, which would not be identifiable simply by observation of the base of the pockets.

Clearly, provided that the principle of the invention is retained, the forms of embodiment and the details of construction can be varied widely from what has been described and illustrated, without departure from the scope of the invention.

The invention claimed is:

1. A method for separating products grouped in a blister pack the method comprising the steps of:

providing a blister pack having a terminal outer edge and a base with a plurality of raised areas located inwardly of the terminal outer edge, each raised area defining a pocket opening at a bottom side of the base and each raised area having a boundary;

detecting positions of the boundaries of the pockets relative to the terminal outer edge of the blister pack with at least one system configured for identifying the positions of the boundaries of the pockets relative to the terminal outer edge of the blister pack;

generating a cutting scheme based on the position of the boundaries of the pockets relative to the terminal outer edge of the blister pack; and separating the products by cutting the blister pack according to the cutting scheme.

2. The method according to claim 1, wherein the step of generating a cutting scheme includes generating a cutting scheme based on positions of the pockets relative to one another on the blister pack and based on positions of the boundaries of the pockets relative to the terminal outer edge of the blister pack.

3. A device for separating products grouped in a blister pack having a terminal outer edge and a base with a plurality of raised areas located inwardly of the terminal outer edge, each raised area defining a pocket opening at a bottom side of the base and each pocket having a boundary, the device comprising:

a cutting head comprising a cutting arrangement for cutting the blister pack;

at least one system configured for identifying positions of the boundaries of the pockets relative to the terminal outer edge of the blister pack; and a control unit for controlling mutual movement between the cutting head and the blister pack according to a cutting scheme based on the positions of the boundaries of the pockets relative to the terminal outer edge of the blister pack.

4. The device according to claim 3, wherein the identification system comprises a three-dimensional profiling device.

5. The device according to claim 4, comprising a further identification system, the further identification system comprising a photometric stereo viewing system.

6. The device according to claim 4, wherein the three-dimensional profiling device is a laser beam profiling device.

7. The device according to claim 6, wherein the laser beam profiling device comprises two video cameras.

8. The device according to claim 3, wherein the identification system comprises a photometric stereo viewing system.

9. The device according to claim 8, wherein the photometric stereo viewing system comprises four projectors and a camera.

* * * * *